US012765651B2

(12) United States Patent
Luo

(10) Patent No.: US 12,765,651 B2
(45) Date of Patent: Oct. 20, 2026

(54) POSITIONING MECHANISM OF AN UMBRELLA

(71) Applicant: Phaeton Manufacturing LLC, Nantong (CN)

(72) Inventor: Xiong Luo, Nantong (CN)

(73) Assignee: Phaeton Manufacturing LLC, Nantong (CN)

( * ) Notice: Subject to any disclaimer, the term of this patent is extended or adjusted under 35 U.S.C. 154(b) by 195 days.

(21) Appl. No.: 18/785,687

(22) Filed: Jul. 26, 2024

(65) Prior Publication Data

US 2025/0031816 A1 Jan. 30, 2025

(30) Foreign Application Priority Data

Jul. 28, 2023 (CN) ..... 202310950861.5

(51) Int. Cl.
*A45B 25/06* (2006.01)
*A45B 23/00* (2006.01)

(52) U.S. Cl.
CPC ..... *A45B 25/06* (2013.01); *A45B 2023/0031* (2013.01); *A45B 2023/0037* (2013.01)

(58) Field of Classification Search
CPC ..... A45B 2023/0031
See application file for complete search history.

(56) References Cited

U.S. PATENT DOCUMENTS

| | | | | |
|---|---|---|---|---|
| 5,284,171 | A * | 2/1994 | Liu | A45B 25/08 135/39 |
| 7,134,442 | B2 * | 11/2006 | Ma | A45B 25/14 135/20.1 |
| 8,104,492 | B2 * | 1/2012 | Dan | A45B 25/14 135/21 |
| 9,930,942 | B2 * | 4/2018 | Ma | A45B 23/00 |
| 10,925,362 | B1 * | 2/2021 | Luo | A45B 25/14 |
| 11,523,664 | B2 * | 12/2022 | Fisher | A45B 23/00 |
| 11,896,097 | B2 * | 2/2024 | Xie | A45B 25/14 |
| 12,225,989 | B1 * | 2/2025 | Zhao | A45B 17/00 |
| 12,408,740 | B2 * | 9/2025 | Browne | A45B 25/08 |
| 2024/0335014 | A1 * | 10/2024 | Ma | A45B 25/22 |

FOREIGN PATENT DOCUMENTS

| | | | | |
|---|---|---|---|---|
| CN | 211510772 U | * | 9/2020 | A45B 23/00 |

* cited by examiner

*Primary Examiner* — Noah C. Hawk
(74) *Attorney, Agent, or Firm* — Wang Law Firm, Inc.

(57) ABSTRACT

A positioning mechanism of an umbrella has a stand; a sliding seat capable of sliding along a length of the stand and; a synchronous toothed belt connected to the stand. The stand has a groove on a periphery of the stand extending along the length of the stand, the synchronous toothed belt is disposed inside the groove; the sliding seat has a toothed block or pin capable of engaging with the synchronous toothed belt, a button is disposed on the sliding seat, a torsion spring is resisted to drive the button to push the toothed block or pin to engage with the synchronous toothed belt. The stand can be machined in various ways and can be in various shapes, and is novel in appearance, easy to machine, firm and stable in positioning, and low in cost.

4 Claims, 14 Drawing Sheets

POSITIONING MECHANISM OF AN UMBRELLA

TECHNICAL FIELD OF THE INVENTION

The present invention relates to a field of outdoor umbrellas, and in particular to a positioning mechanism of an umbrella.

BACKGROUND OF THE INVENTION

As a kind of outdoor leisure items, umbrellas are widely applied in squares, beaches, parks, gardens or similar places to shield an individual from sun, wind and rain. The existing side-support umbrella in the market generally comprises a base, a stand, a transverse rod, a drawing rod and an umbrella frame, wherein a bottom end of the transverse rod is connected to the stand, while a top end thereof is connected to a top of the umbrella frame; a bottom end of the drawing rod is connected to a top of the stand, while a top end thereof is connected to a middle portion of the transverse rod; the stand is inserted into the base; the top of the umbrella frame is connected to the top end of the transverse rod in a rotatable manner; a slider is sleeved on the stand; and, the bottom end of the transverse rod is connected to the slider. The slider is positioned on the stand through a positioning mechanism and capable of being slidable along a length of the stand, thereby controlling a folding or unfolding of the frame. Most positioning mechanisms are performed in such a way: the stand has a slot formed on the stand, a toothed belt is connected to the stand, a handle and a clamping pin are disposed on the slider, the handle is rotated to engage the clamping pin with the toothed belt for adjustment. However, slotting is relatively troublesome, and the traditional stand is relatively simple in shape and molding, complicated in machining, and not novel. In addition, the positioning mechanism is relatively simple and needs to be further improved.

For example, a Chinese Patent CN211510772U (patent No.: CN201922444437.5) disclosed an umbrella canopy adjustment mechanism and an umbrella thereof, comprising a housing, a stand, wherein the stand has a groove on a periphery of the stand extending along the length of the stand; a toothed belt is located in the groove to be connected to the stand; the housing is sleeved on the stand and hinged to an inner end of a transverse rod; a rotatable handle is disposed on the housing; a clamping pin capable of being buckled with the toothed belt is located in the housing; one end of the clamping pin is buckled with the toothed belt, while the other end thereof is connected to the handle and can slide back and forth in the housing under a rotation of the handle so as to realize the engagement with or disengagement from the toothed belt; and, a spring is resisted between the handle and the housing, urging the handle to drive the clamping pin to engage with the toothed belt. The groove is formed on the periphery of the stand of the umbrella, and the slider is positioned with the stand in such a way that the handle is rotated to drive the clamping pin. However, the structure and molding mode of the stand are not described and improved.

SUMMARY OF THE INVENTION

It is an object of the present invention to provide a positioning mechanism for an umbrella, which is simple and reasonable in structure and easy to machine.

For achieving the above object, the positioning mechanism for an umbrella comprises a stand; a sliding seat connected to the stand and being capable of sliding along a length of the stand; a synchronous toothed belt connected to the stand; wherein, the stand has a groove on a periphery of the stand extending along the length of the stand, the synchronous toothed belt is disposed inside the groove through a plurality of screws; the sliding seat has a toothed block or pin capable of engaging with the synchronous toothed belt, a button being rotatably connected to the toothed block or pin is disposed on the sliding seat, a torsion spring is resisted between the button and the sliding seat so as to drive the button to push the toothed block or pin to engage with the synchronous toothed belt; the stand is formed by bend welding, extrusion molding or cold drawing, the groove is formed on the periphery of the stand during a forming process of the stand, the groove has an opening and a width of the opening is smaller than the maximum width of the groove.

As an improvement, the stand has a front side and a rear side, the groove is formed at the rear side of the stand and has a cross section in an arc shape, correspondingly, the synchronous toothed belt has a cross section in a trimmed circle adapted to the groove; the synchronous toothed belt is located inside the groove, the synchronous toothed belt has at least two connecting holes at a top end and a bottom end of the synchronous toothed belt, the synchronous toothed belt is connected to the stand through a plurality of screws each passing through one connecting hole of the synchronous toothed belt and being screwed on the stand, the synchronous toothed belt has a stopper on the top end of the synchronous toothed belt; or the synchronous toothed belt s located inside the groove, the synchronous toothed belt has a retaining block respectively at a top end and a bottom end of the synchronous toothed belt, and each retaining block has a mounting hole for receiving a screw so as to connect the synchronous toothed belt to the stand.

Preferably, the sliding seat comprises a pair of half sliding seats, a left half sliding seat and a right half sliding seat, which are connected to each other to form the siding seat with a through hole at a middle portion of the sliding seat for allowing the stand to pass through, the sliding seat has a front end and a rear end, the sliding seat has a transverse rod mounting seat being used for connecting to a bottom end of a transverse rod on the front end of the sliding seat, and a mounting port for mounting the button on the rear end of the sliding seat, a middle portion of the button is connected to the sliding seat through a rotating shaft, and a top end of a side surface of the button adjacent to the mounting port is rotatably connected to the toothed block or pin.

Preferably, a cross section of the stand is circular, square, rectangular, elliptical, polygonal or special-shaped.

A positioning mechanism of a umbrella comprises a stand; a sliding seat; a synchronous toothed belt connected to the stand; wherein, the stand is machined by molding first and then punching, the stand has a plurality of positioning indentations which are formed at regular intervals on a periphery of the stand extending along a length of the stand, the sliding seat has a clamping pin capable of being inserted into a positioning indentation of the plurality of positioning indentations, the clamping pin has an outer end and an inner end, the inner end of the clamping pin is capable of being inserted into each positioning indentation, a handle is disposed on the sliding seat, a handle inserted-piece facing the stand is connected to the handle, the outer end of the clamping pin is connected to the handle inserted-piece, a plurality of springs is positioned between the handle inserted-piece and the handle, urging the handle inserted-piece to move toward the stand so as to drive the clamping pin to insert into the positioning indentation of the plurality of positioning indentations.

Preferably, the stand has a front side and a rear side, the plurality of positioning indentations is formed at the front side of the stand, each positioning indentation has a concaved circular shape, the positioning indentations are formed at regular intervals along the length of the stand.

Preferably, the sliding seat comprises a sleeve adapted to the stand, an front end of the sleeve facing the positioning indentations has an opening with two sides, two sides of the opening extend forward and downward to form a U-shaped mounting seat having an upper portion and a lower portion, a bottom end of a transverse rod is connected to the upper portion of the mounting seat and the handle is connected to the lower portion of the mounting seat, the handle has an inverted L-shape.

Finally, the handle has a positioning hole at a middle portion of the handle inserted-piece, the outer end of the clamping pin is positioned in the positioning hole and can move telescopically.

Compared with the prior art, the positioning mechanism of an umbrella of the present invention has the following advantages. The stand is formed by bent welding, extrusion molding or cold drawing. The synchronous toothed belt is located inside the groove and connected to the stand through the plurality of screws or stoppers. The sliding seat is engaged with the synchronous toothed belt through the button being rotatably connected to the toothed block or pin. Or, the stand is machined by molding first and then punching, and the plurality of positioning indentations are formed on the periphery of the stand extending along the length of the stand. The sliding seat is positioned with the positioning indentations on the stand through the clamping pin and the handle. The stand of the present invention can be machined in various way and can be in various shapes such as circle, special shape or square, and is novel in appearance, easy to machine, firm and stable in positioning, and low in cost.

BRIEF DESCRIPTION OF THE DRAWINGS

FIG. 11 is a sectional view of the stand in FIG. 10 with the synchronous toothed belt mounted on;

FIG. 13 is a sectional view of the stand in FIG. 12 with the synchronous toothed belt mounted on;

DETAILED DESCRIPTION OF THE INVENTION

Figure 1:
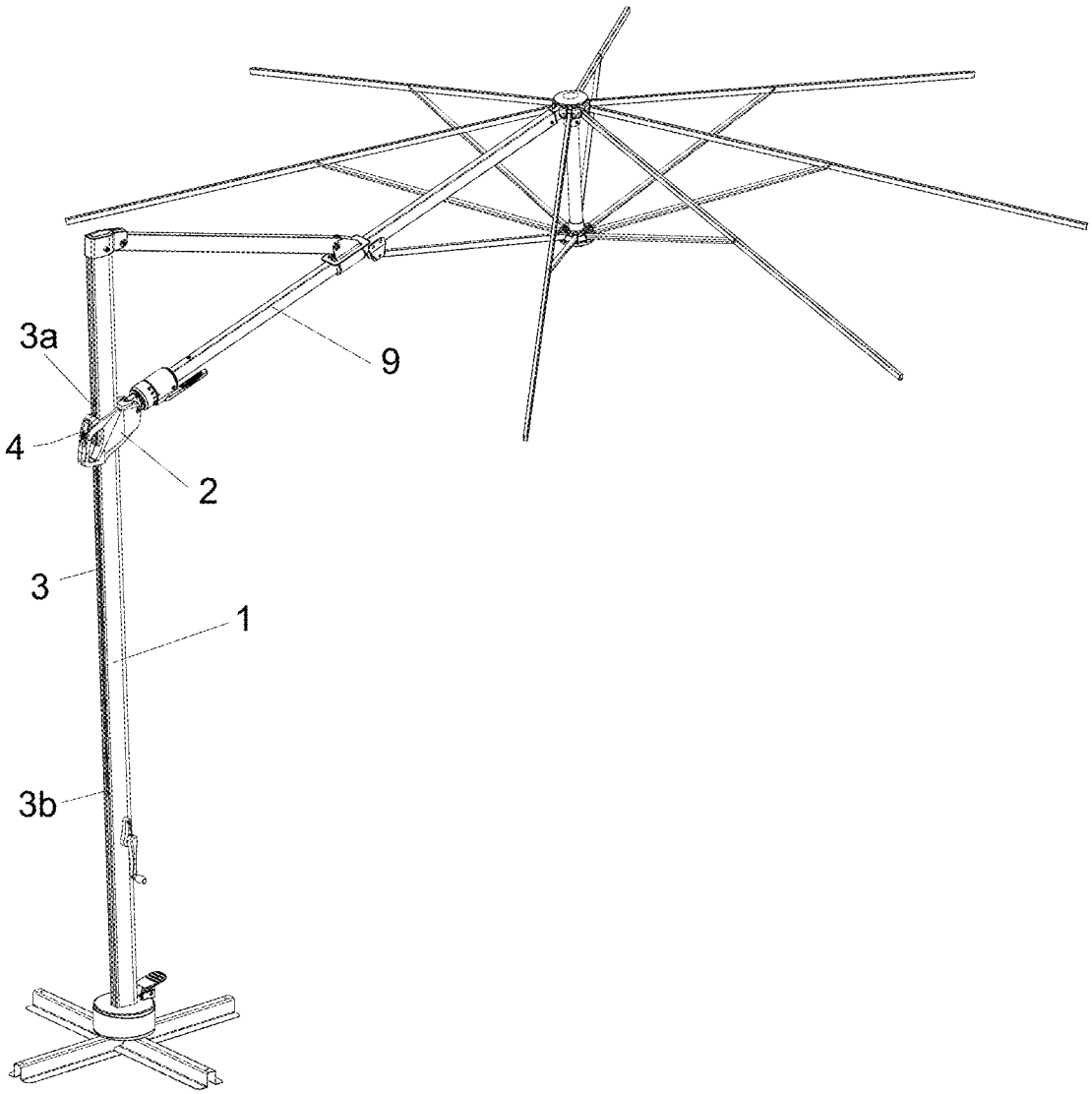
FIG. 1 is a perspective view of an umbrella according to Embodiment 1 of the present invention.
Figure 2:
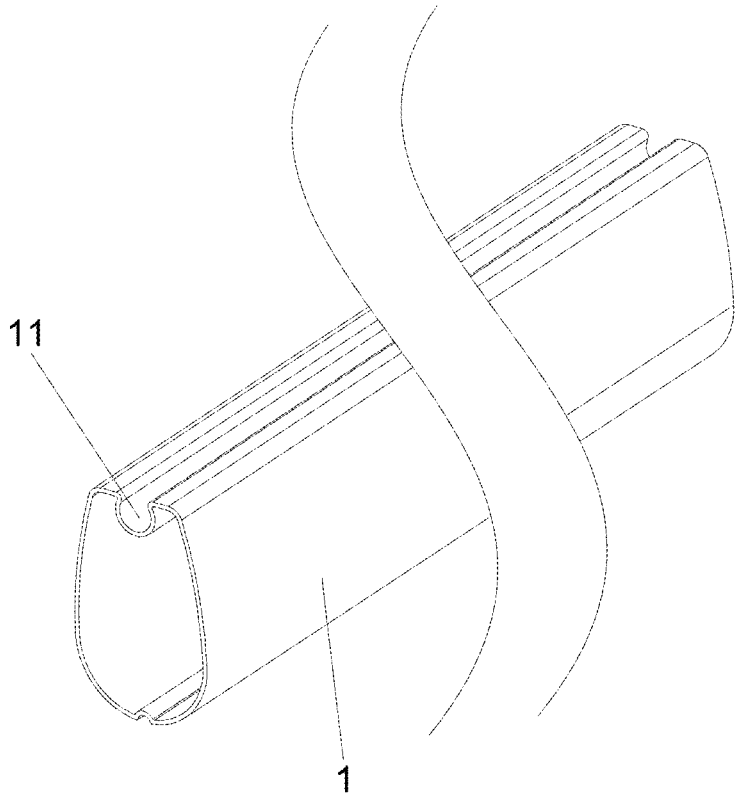
FIG. 2 is a perspective view of a stand formed by extrusion molding according to Embodiment 1 of the present invention.
Figure 3:
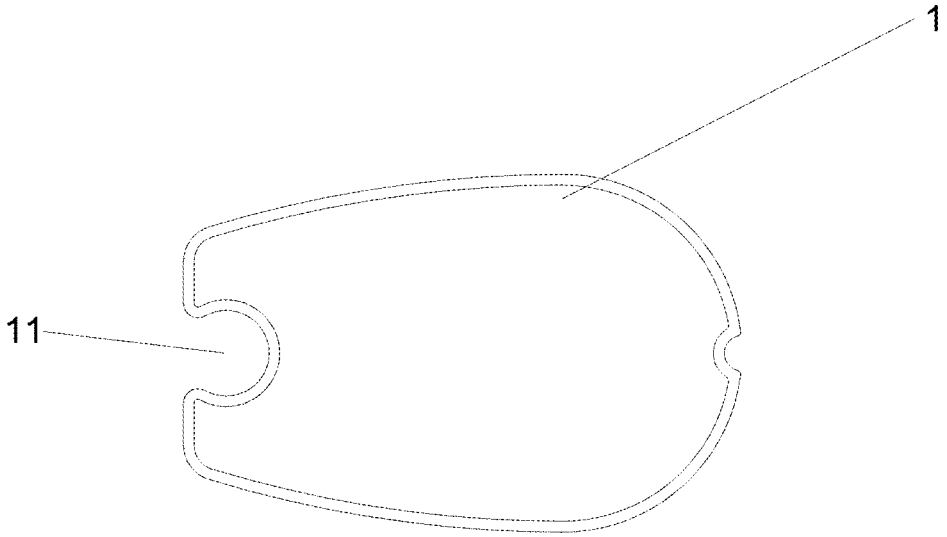
FIG. 3 is a sectional view of the FIG. 2.

The present invention will be further described below in detail by embodiments with reference to the accompanying drawings.

Embodiment 1

The positioning mechanism of an umbrella comprises a stand 1 and a sliding seat 2 connected to the stand 1 and being capable of sliding along a length of the stand 1. The stand 1 is formed by extrusion molding or cold drawing and has a groove 11 with an opening on a periphery of the stand 1 extending along the length of the stand 1. The synchronous toothed belt 3 is disposed inside the groove 11 and is connected to the stand 1 through a plurality of screws. The sliding seat 2 has a toothed block 5 or pin capable of engaging with the synchronous toothed belt 3, a button 4 being rotatably connected to the toothed block 5 or pin is disposed on the sliding seat 2, a torsion spring 40 is resisted between the button 4 and the sliding seat 2 so as to drive the button 4 to push the toothed block 5 or pin to engage with the synchronous toothed belt 3.

Figure 4:
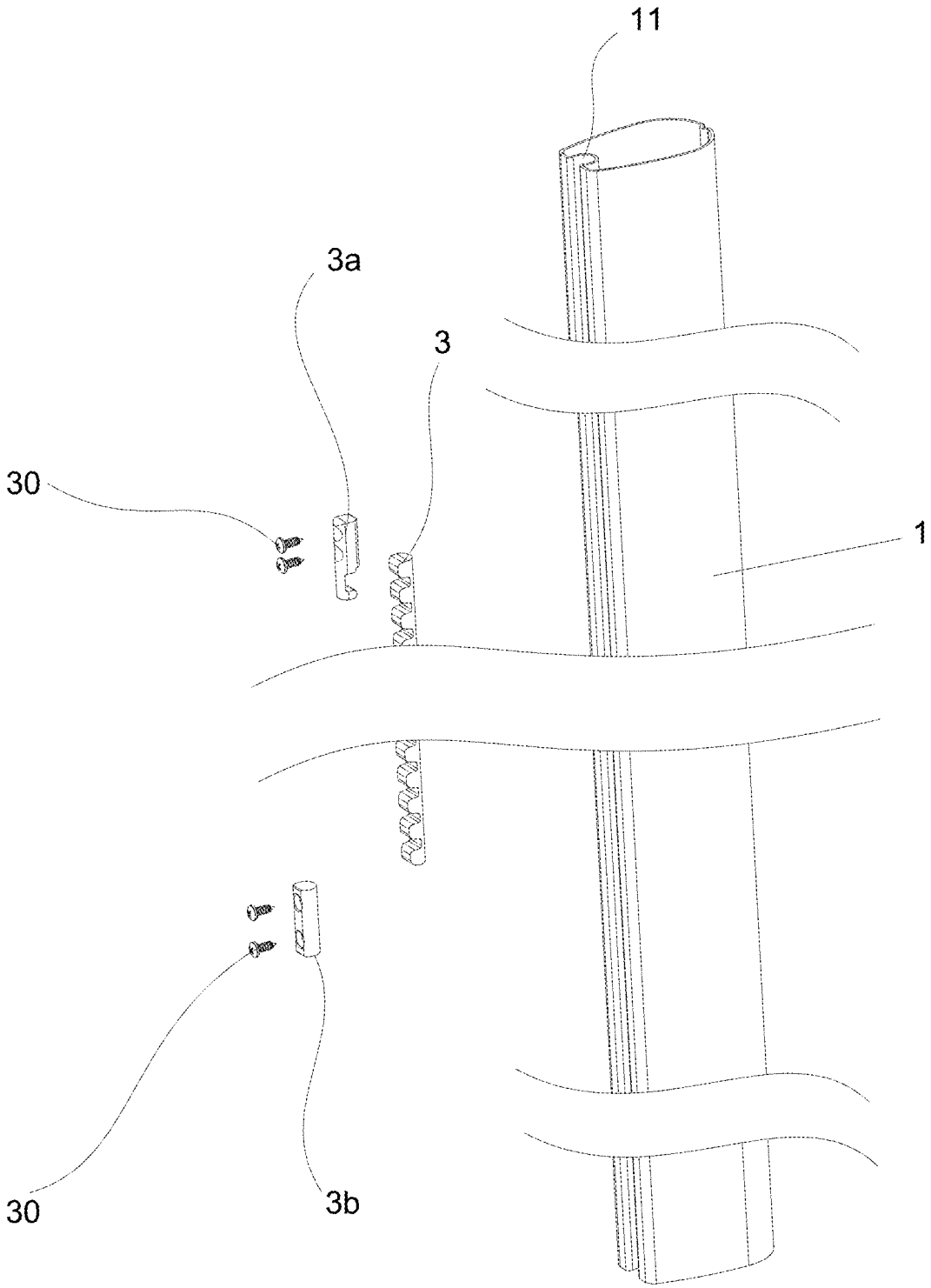
FIG. 4 is an exploded view of a synchronous toothed belt and the stand according to Embodiment 1 of the present invention showing a manner of mounting together.
Figure 5:
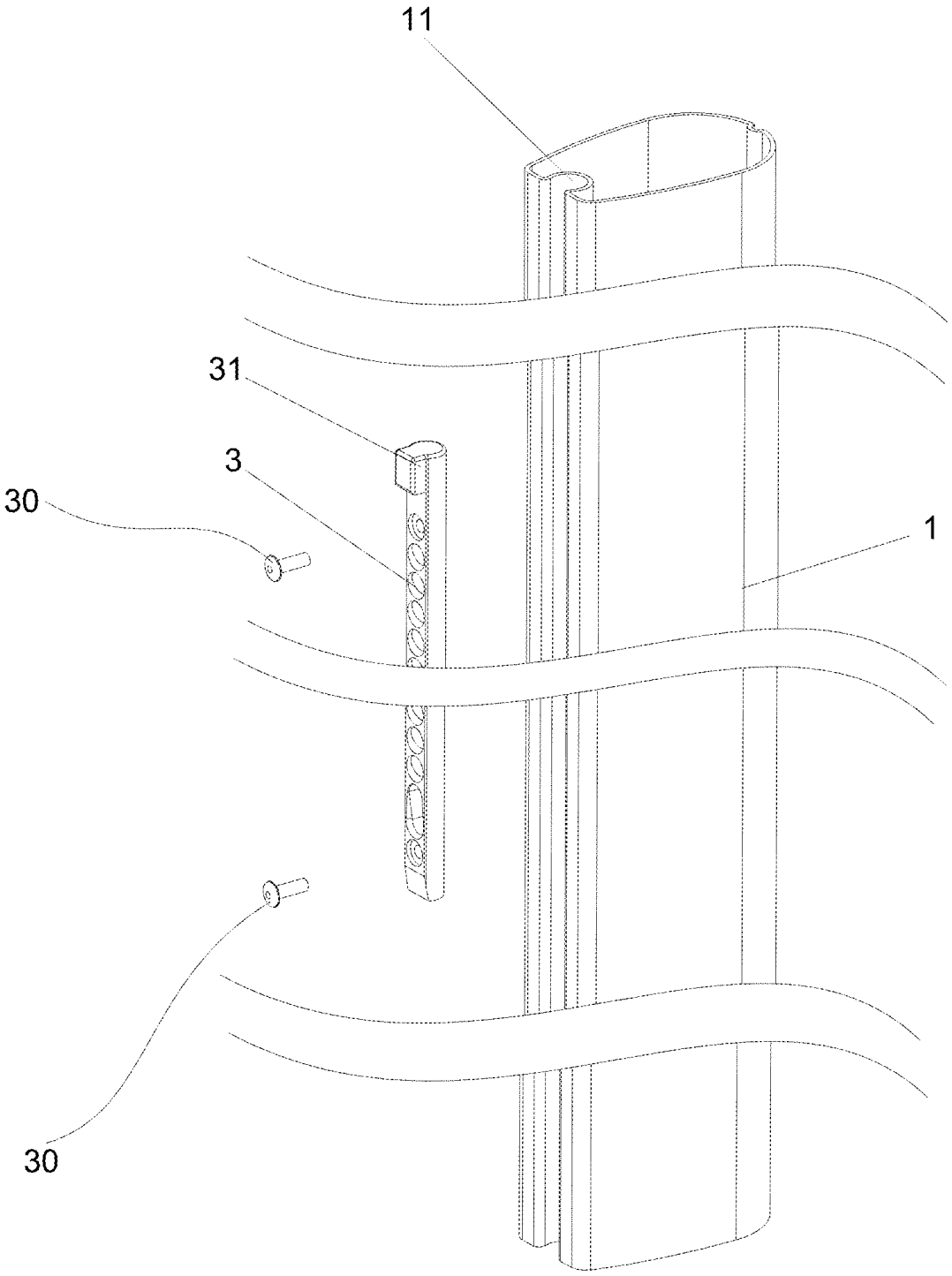
FIG. 5 is an exploded view of the synchronous toothed belt and the stand showing another manner of mounting together.
Figure 6:
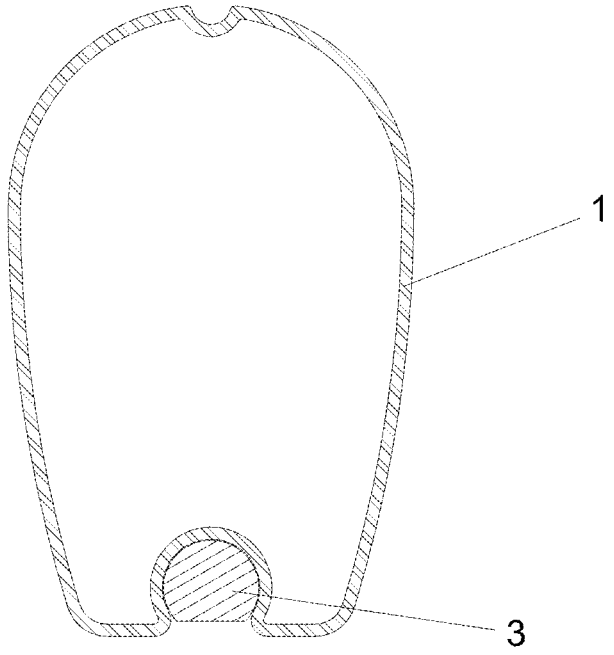
FIG. 6 is a sectional view of the stand with the synchronous toothed belt mounted on according to Embodiment 1 of the present invention.
Figure 7:
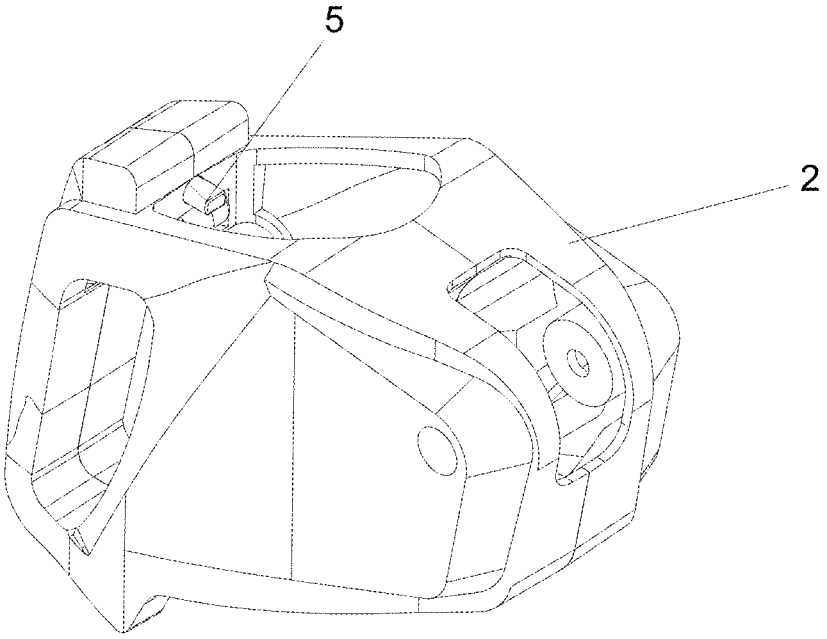
FIG. 7 is a perspective view of a sliding seat according to Embodiment 1 of the present invention.
Figure 8:
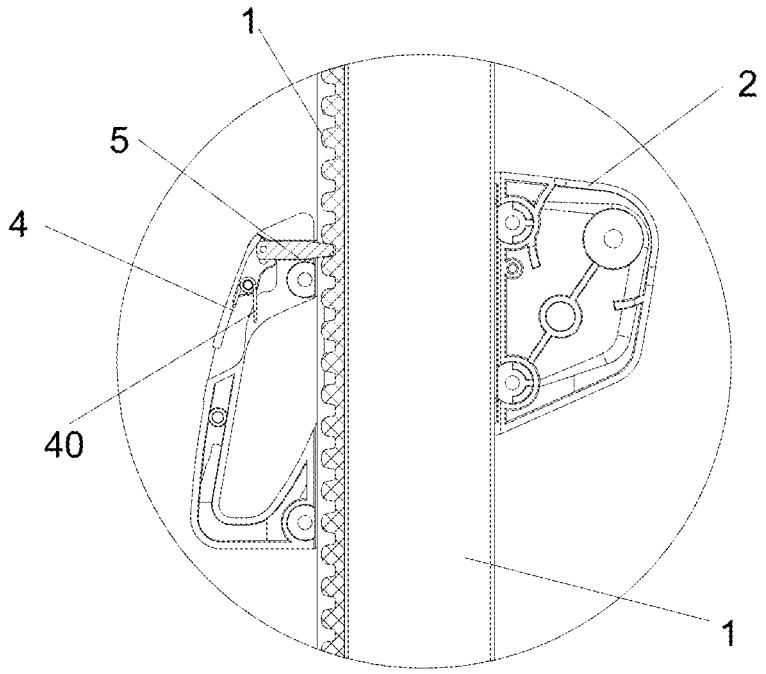
FIG. 8 is a sectional view of the sliding seat and the stand according to Embodiment 1 of the present invention when the sliding seat is engaged with the synchronous toothed belt.
Figure 9:
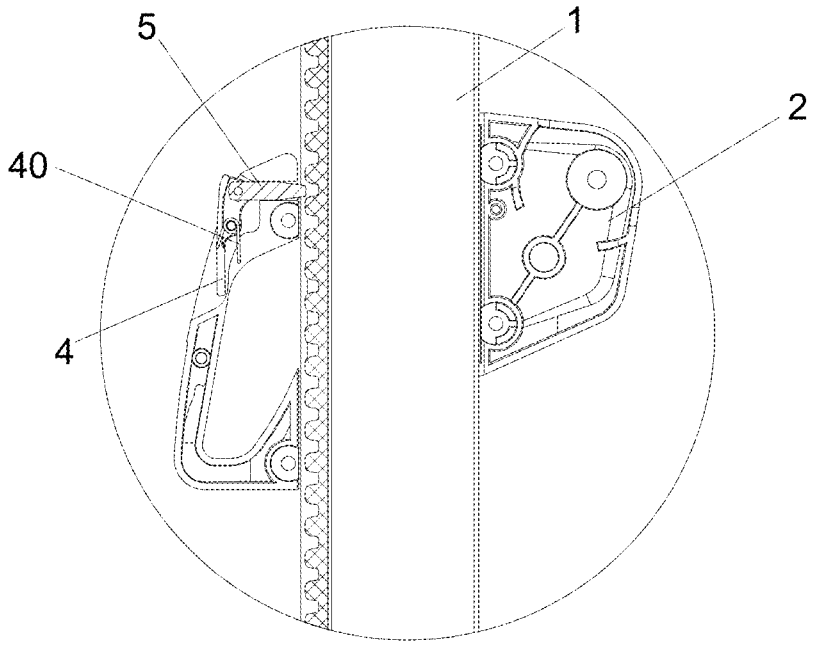
FIG. 9 is a sectional view of the sliding seat and the stand according to Embodiment 1 of the present invention when the sliding seat is disengaged from the synchronous toothed belt.

Specifically, the stand 1 has a front side and a rear side, the groove 11 in this embodiment is formed at the rear side of the stand 1 and has a cross section in an arc shape, correspondingly, the synchronous toothed belt 3 has a cross section in a trimmed circle adapted to the groove 11. The synchronous toothed belt 3 can be designed in two structures. The first structure of the synchronous toothed belt 3 is as shown in FIG. 5, wherein the synchronous toothed belt 3 has at least two connecting holes at a top end and a bottom end of the synchronous toothed belt 3, and the stand 1 has corresponding thorough holes on the periphery of the stand 1; the synchronous toothed belt 3 is connected to the stand 1 through a plurality of screws each passing through one connecting hole of the synchronous toothed belt 3 and being screwed on the stand 1; the synchronous toothed belt 3 has a stopper 31 on the top end of the synchronous toothed belt 3. The second structure of the synchronous toothed belt 3 is as shown in FIG. 4, wherein the synchronous toothed belt 3 has a retaining block respectively 3*a*/3*b* at a top end and a bottom end of the synchronous toothed belt 3, and each retaining block 3*a*/3*b* has a mounting hole for receiving a screw 30 so as to connect the synchronous toothed belt 3 to the stand 1. The sliding seat 2 comprises a pair of half sliding seats, a left half sliding seat and a right half sliding seat, which are connected to each other to form the siding seat 2 with a through hole at a middle portion of the sliding seat 2 for allowing the stand 1 to pass through, the sliding seat 2 has a front end and a rear end, the sliding seat 2 has a transverse rod mounting seat being used for connecting to a bottom end of a transverse rod 9 on the front end of the sliding seat 2, and a mounting port for mounting the button 4 on the rear end of the sliding seat 2, a middle portion of the button 4 is connected to the sliding seat 2 through a rotating shaft, and a top end of a side surface of the button 4 adjacent to the mounting port is rotatably connected to the toothed block 5 or pin. The internal configuration and positioning mechanism of the sliding seat 2 in this embodiment are the same as that of the existing sliding seats in prior art and will not be specifically described here.

Figure 10:
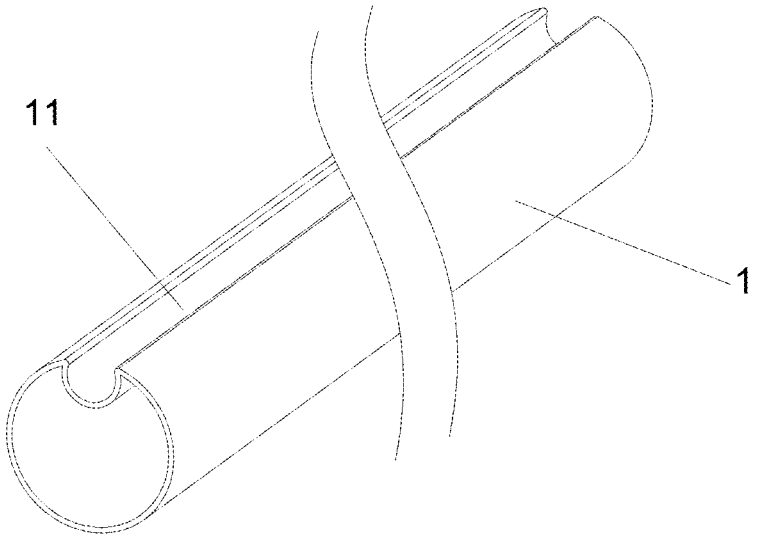
FIG. 10 is a perspective view of the stand with the synchronous toothed belt mounted on according to Embodiment 1 of the present invention when the stand is in a circular shape.
Figure 11:
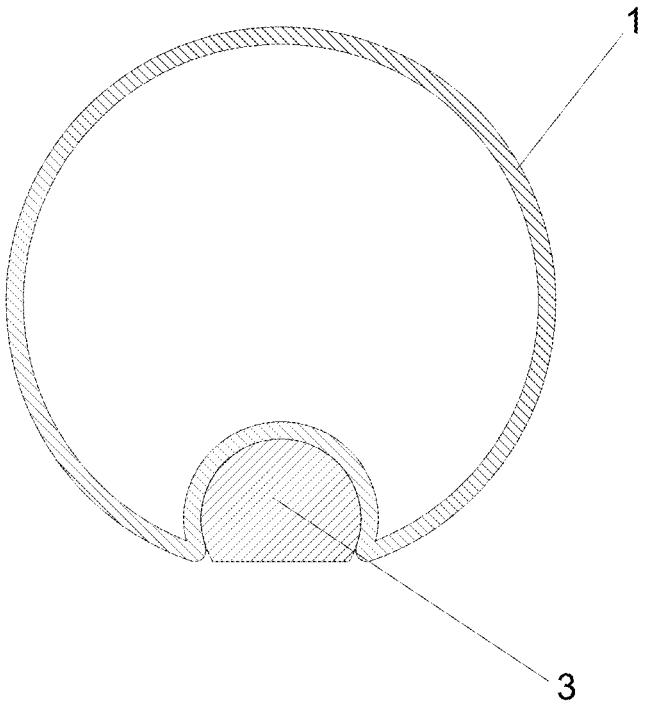
Figure 12:
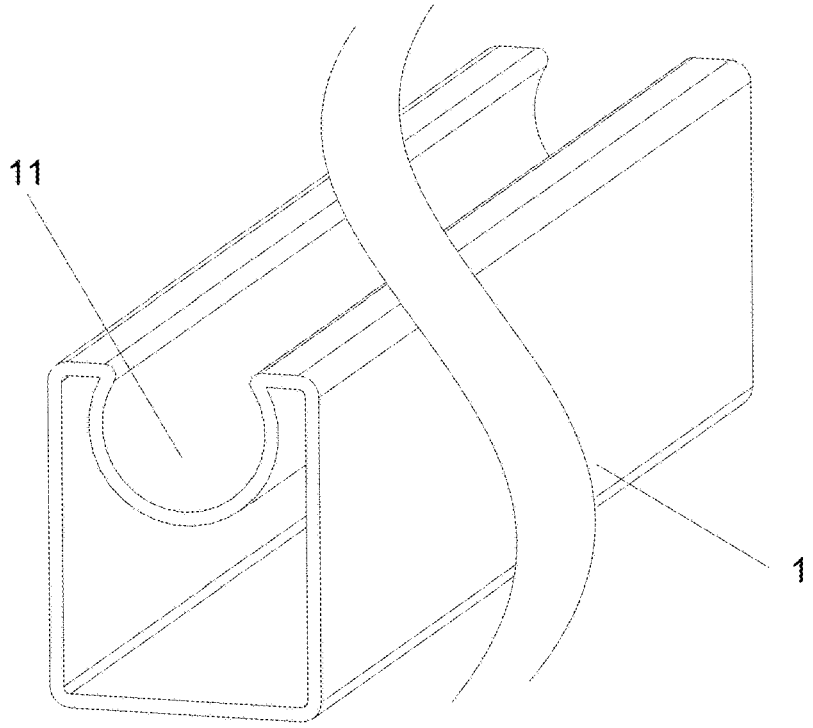
FIG. 12 is a perspective view of the stand according to Embodiment 1 of the present invention when the stand is in a rectangular shape.
Figure 13:
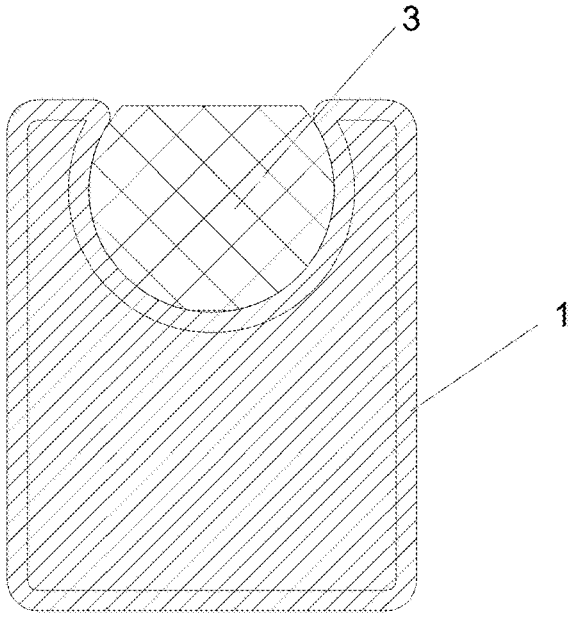
Figure 14:
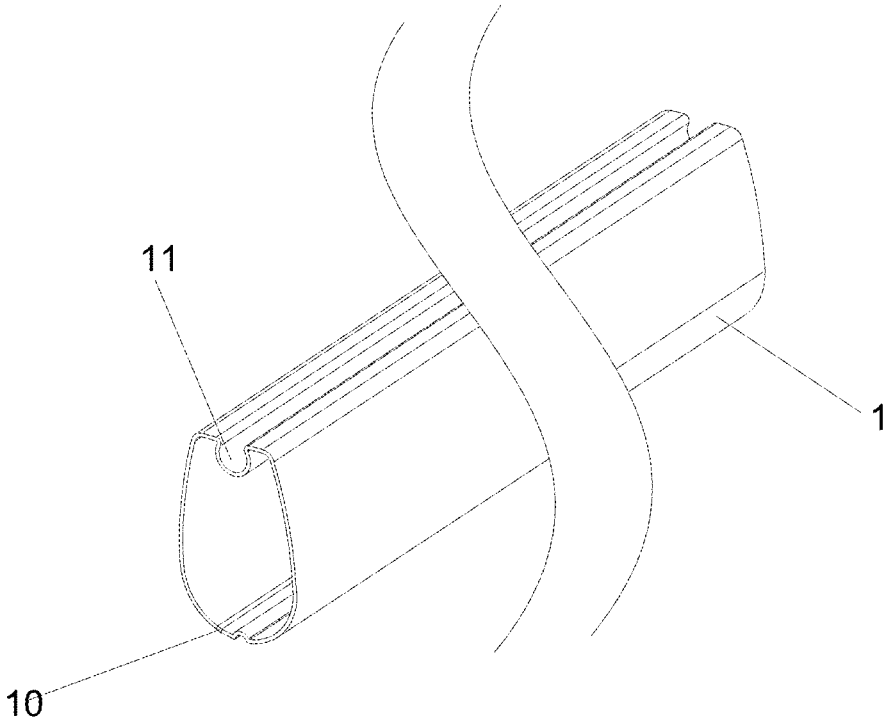
FIG. 14 is a perspective view of a stand formed by bend welding according to Embodiment 2 of the present invention.
Figure 15:
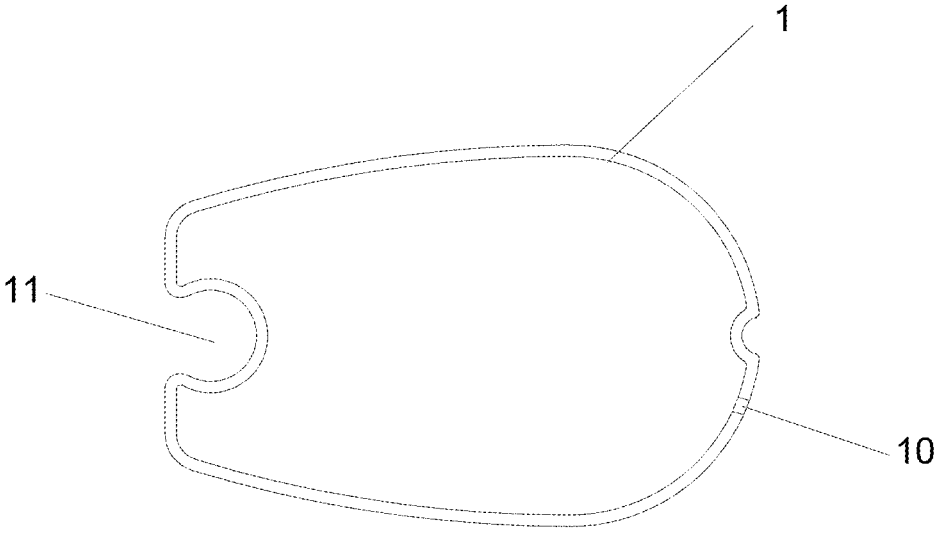
FIG. 15 is a sectional view of the FIG. 14.
Figure 16:
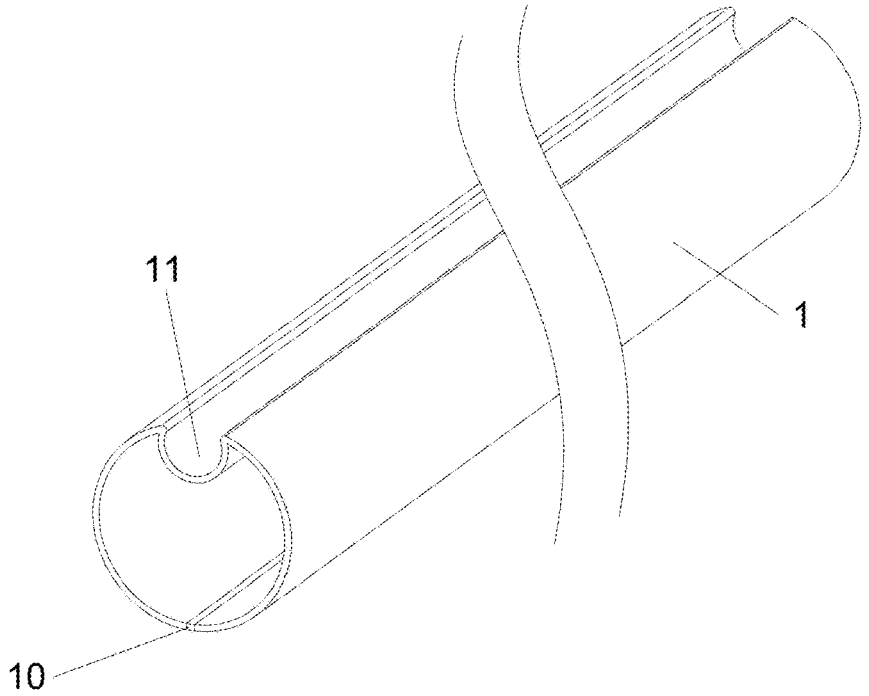
FIG. 16 is a perspective view of the stand according to Embodiment 2 of the present invention when the stand is in a circular shape.
Figure 17:
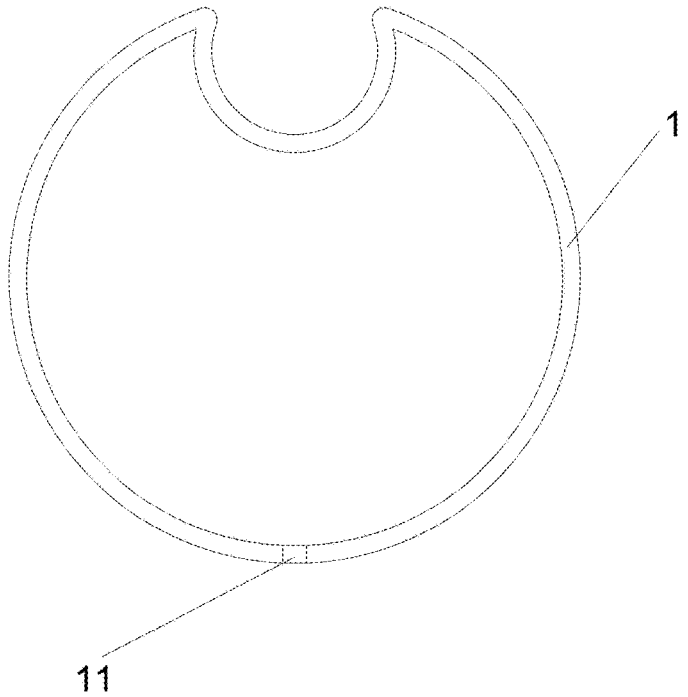
FIG. 17 is a sectional view of the FIG. 16.
Figure 18:
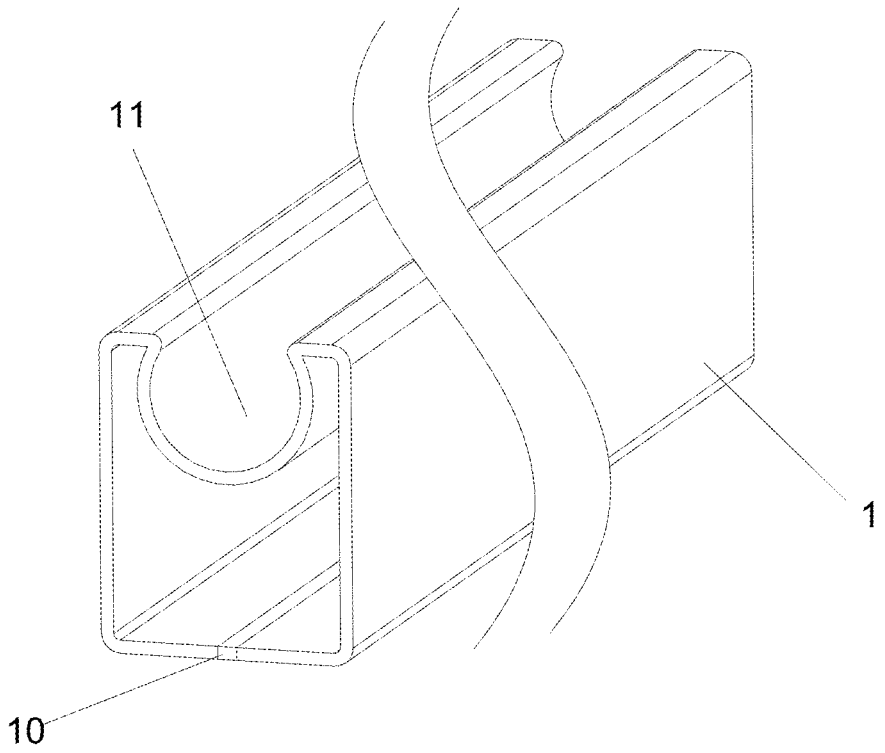
FIG. 18 is a perspective view of the stand according to Embodiment 2 of the present invention when the stand is in a rectangular shape.
Figure 19:
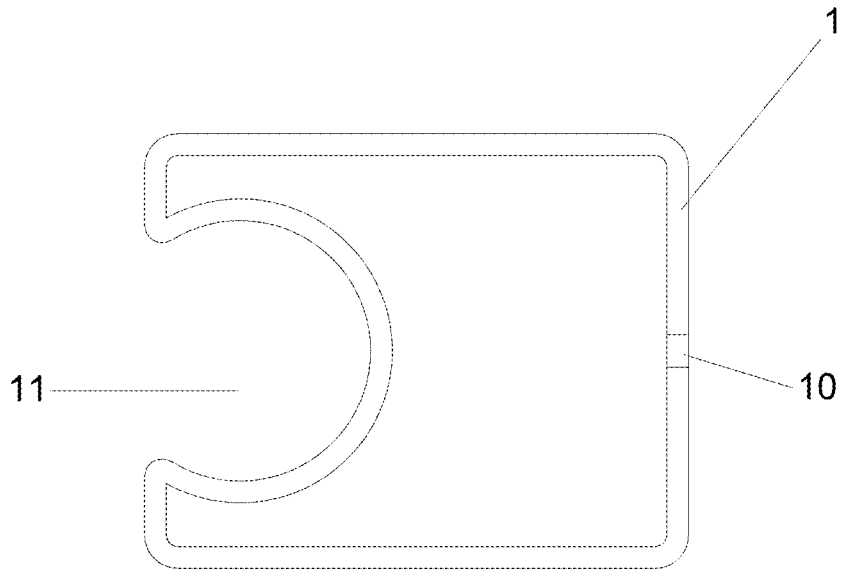
FIG. 19 is a sectional view of the FIG. 18.
Figure 20:
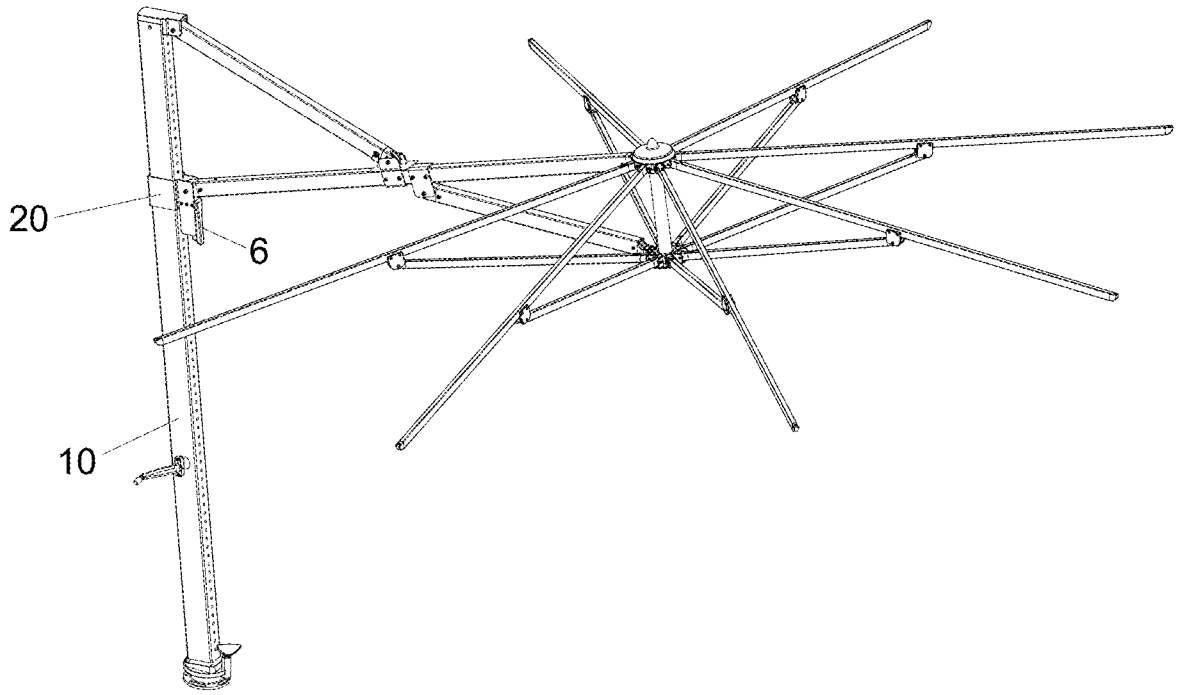
FIG. 20 is a perspective view of an umbrella according to Embodiment 3 of the present invention.
Figure 21:
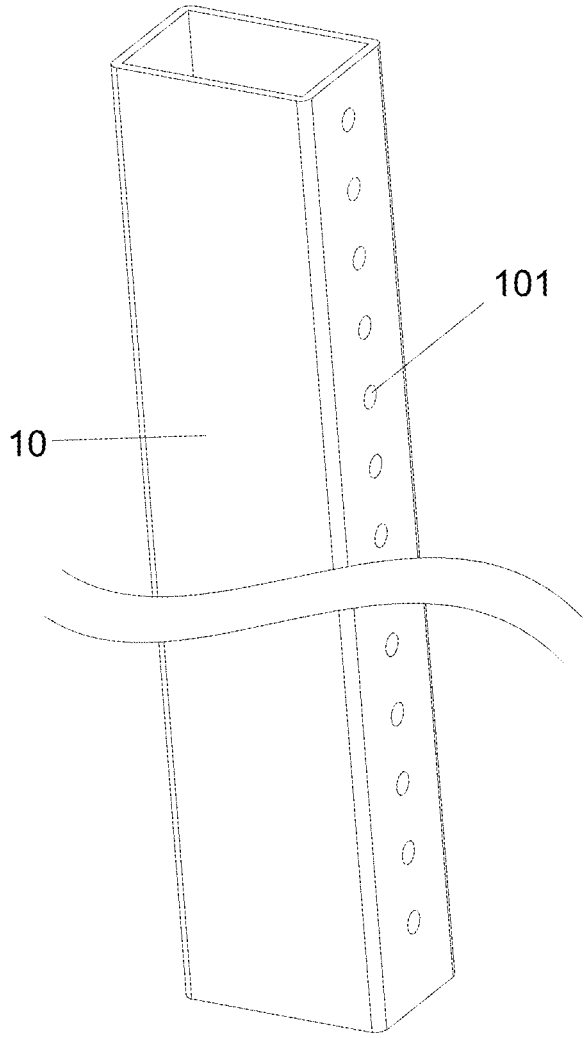
FIG. 21 is an enlarged view of a part of a stand according to Embodiment 3 of the present invention.
Figure 22:
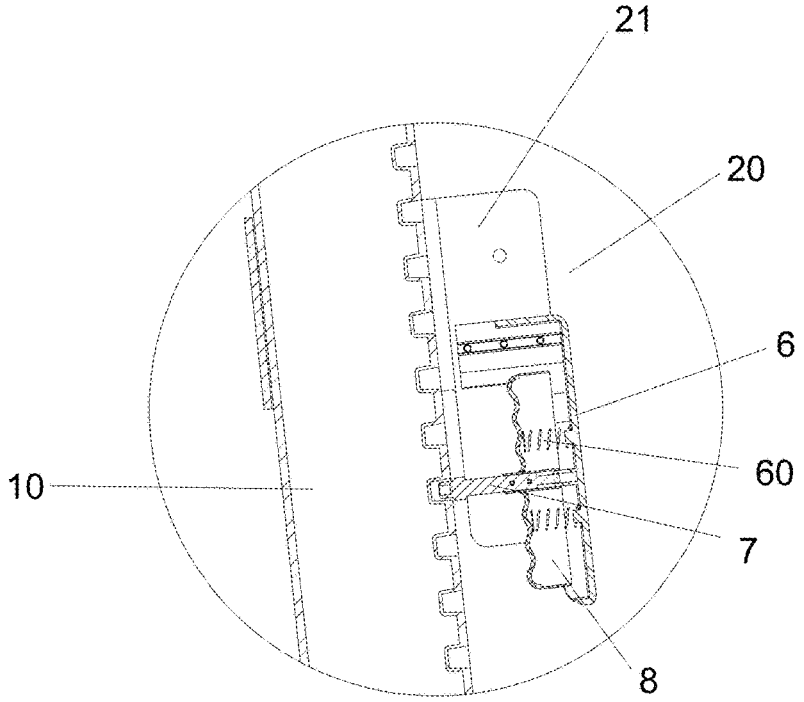
FIG. 22 is a sectional view of the stand and the siding seat according to Embodiment 3 of the present invention when the sliding seat is engaged with the stand.
Figure 23:
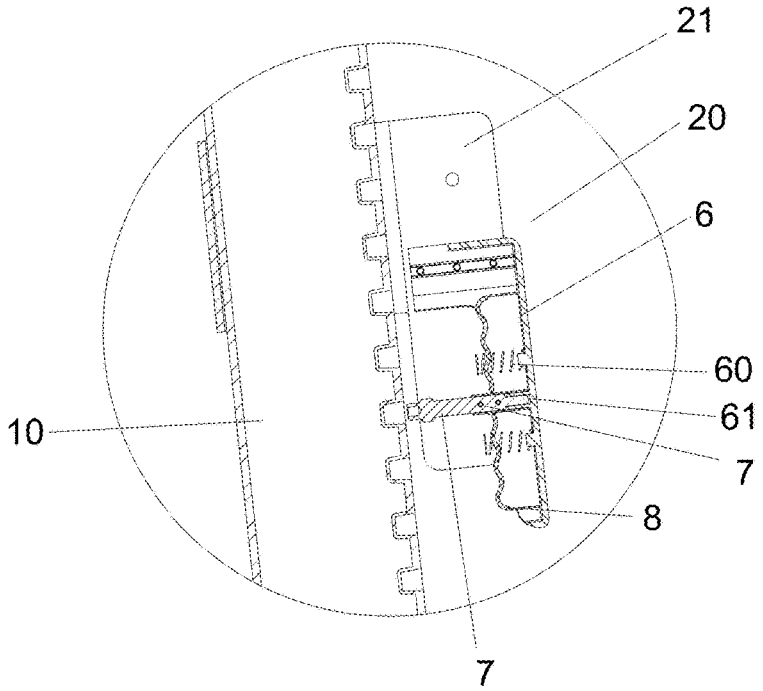
FIG. 23 is a sectional view of the stand and the siding seat according to Embodiment 3 of the present invention when the sliding seat is disengaged from the stand.

The cross section of the stand 1 can be circular, as shown in FIGS. 10 and 11, or can be square or rectangular, as shown in FIGS. 12 and 13, or can be elliptic, polygonal or special-shaped.

When in use, the button 4 is pressed down, the toothed block 5 or pin is disengaged from the synchronous toothed belt 3, and the angle of an umbrella frame can be adjusted by sliding the sliding seat 2 up and down along the length of the stand 1. After the umbrella frame is adjusted at a desired position, the button 4 is released, the toothed block 5 or pin is engaged with the synchronous toothed belt 3 so that the sliding seat 2 is positioned.

Embodiment 2

As shown in FIGS. 14-19, a positioning mechanism for an umbrella in this embodiment differs from that in Embodiment 1 in that: the stand 1 is formed by bend welding, and the position of a welded joint is not limited.

Embodiment 3

As shown in FIGS. 20-23, a positioning structure for an umbrella comprises a stand 10; a sliding seat 20; a synchronous toothed belt 3 connected to the stand 10; wherein, the stand 10 is machined by molding first and then punching, the stand 10 has a plurality of positioning indentations 101 which are formed at regular intervals on a periphery of the stand 10 extending along a length of the stand 10, the sliding seat 20 has a clamping pin 7 capable of being inserted into a positioning indentation 101 of the plurality of positioning indentations 101, the clamping pin 7 has an outer end and an inner end, a handle 6 is disposed on the sliding seat 20, the outer end of the clamping pin 7 is connected to the handle 6.

The stand 10 has a front side and a rear side, the plurality of positioning indentations 101 is formed at the front side of the stand 10, each positioning indentation 101 has a concaved circular shape, the positioning indentations 101 are formed at regular intervals along the length of the stand 10. The sliding seat 20 comprises a sleeve adapted to the stand 10, an front end of the sleeve facing the positioning indentations 101 has an opening with two sides, two sides of the opening extend forward and downward to form a U-shaped mounting seat 21 having an upper portion and a lower portion, a bottom end of a transverse rod 9 is connected to the upper portion of the mounting seat 21 and the handle 6 is connected to the lower portion of the mounting seat 21, the handle 6 has an inverted L-shape. A handle inserted-piece 8 facing the stand 10 is connected to the handle 6, the outer end of the clamping pin 7 is connected to the handle inserted-piece 8. Generally, the handle 6 has a positioning hole 61 at a middle portion of the handle inserted-piece 8, the outer end of the clamping pin 7 is positioned in the positioning hole 61 and can move telescopically. A plurality of springs 60 is positioned between the handle inserted-piece 8 and the handle 6, urging the handle inserted-piece 8 to move toward the stand 10 so as to drive the clamping pin 7 to insert into the positioning indentation 101 of the plurality of positioning indentations 101.

The cross section of the stand 10 in this embodiment is rectangular. In practical applications, the cross section of the stand 10 can also be square, circular or in other shapes.

When in use, the handle inserted-piece 8 is pulled away from the stand 10 so that the clamping pin 7 is disengaged from the positioning indentation 101, and the angle of an umbrella frame can be adjusted by sliding the sliding seat 20 up and down along the length of the stand 10. After an umbrella frame is adjusted at a desired position, the handle insert-piece 8 is released, the clamping pin 7 is inserted into the positioning indentation 101 so that the sliding seat 20 is positioned.

The protection scope of the present invention is not limited to each embodiment described in this description. Any changes and replacements made on the basis of the scope of the present invention patent and of the description shall be included in the scope of the present invention patent.

The invention claimed is:

1. A positioning mechanism of an umbrella, comprising:

a stand;

a sliding seat connected to the stand and being capable of sliding along a length of the stand;

a synchronous toothed belt connected to the stand;

wherein, the stand has a groove on a periphery of the stand extending along the length of the stand, the synchronous toothed belt is disposed inside the groove;

the stand has a front side and a rear side, the groove is formed at the rear side of the stand and has a cross section in an arc shape, correspondingly, the synchronous toothed belt has a cross section in a trimmed circle adapted to the groove;

the sliding seat has a toothed block or pin capable of engaging with the synchronous toothed belt, a button being rotatably connected to the toothed block or pin is disposed on the sliding seat, a torsion spring is resisted between the button and the sliding seat so as to drive the button to push the toothed block or pin to engage with the synchronous toothed belt;

the synchronous toothed belt is located inside the groove, the synchronous toothed belt has at least two connecting holes at a top end and a bottom end of the synchronous toothed belt, the synchronous toothed belt is connected to the stand through a plurality of screws each passing through one connecting hole of the synchronous toothed belt and being screwed on the stand, the synchronous toothed belt has a stopper on the top end of the synchronous toothed belt;

the stand is formed by bend welding, extrusion molding or cold drawing, the groove is formed on the periphery of the stand during a forming process of the stand, the groove has an opening and a width of the opening is smaller than the maximum width of the groove.

2. The positioning mechanism of claim 1, wherein the sliding seat comprises a pair of half sliding seats, a left half sliding seat and a right half sliding seat, which are connected to each other to form the siding seat with a through hole at a middle portion of the sliding seat for allowing the stand to pass through, the sliding seat has a front end and a rear end, the sliding seat has a transverse rod mounting seat being used for connecting to a bottom end of a transverse rod on the front end of the sliding seat, and a mounting port for mounting the button on the rear end of the sliding seat, a middle portion of the button is connected to the sliding seat through a rotating shaft, and a top end of a side surface of the button adjacent to the mounting port is rotatably connected to the toothed block or pin.

3. The positioning mechanism of claim 1, wherein a cross section of the stand is circular, square, rectangular, elliptical, polygonal or special-shaped.

4. A positioning mechanism of an umbrella, comprising:

a stand;

a sliding seat connected to the stand and being capable of sliding along a length of the stand;

a synchronous toothed belt connected to the stand;

wherein, the stand has a groove on a periphery of the stand extending along the length of the stand, the synchronous toothed belt is disposed inside the groove;

the stand has a front side and a rear side, the groove is formed at the rear side of the stand and has a cross section in an arc shape, correspondingly, the synchronous toothed belt has a cross section in a trimmed circle adapted to the groove;

the sliding seat has a toothed block or pin capable of engaging with the synchronous toothed belt, a button being rotatably connected to the toothed block or pin is disposed on the sliding seat, a torsion spring is resisted between the button and the sliding seat so as to drive the button to push the toothed block or pin to engage with the synchronous toothed belt;

the synchronous toothed belt is located inside the groove, the synchronous toothed belt has a retaining block respectively at a top end and a bottom end of the synchronous toothed belt, and each retaining block has a mounting hole for receiving a screw so as to connect the synchronous toothed belt to the stand;

the stand is formed by bend welding, extrusion molding or cold drawing, the groove is formed on the periphery of the stand during a forming process of the stand, the groove has an opening and a width of the opening is smaller than the maximum width of the groove.

* * * * *